US010139057B2

(12) United States Patent
Gromfeld

(10) Patent No.: US 10,139,057 B2
(45) Date of Patent: Nov. 27, 2018

(54) OPTICAL MODULE FOR PROJECTING A CUTOFF LIGHT BEAM INCLUDING HORIZONTALLY FOCUSING MEANS

(71) Applicant: VALEO VISION, Bobigny (FR)

(72) Inventor: Yves Gromfeld, Angers (FR)

(73) Assignee: VALEO VISION, Bobigny (FR)

( * ) Notice: Subject to any disclaimer, the term of this patent is extended or adjusted under 35 U.S.C. 154(b) by 0 days.

(21) Appl. No.: 15/794,066

(22) Filed: Oct. 26, 2017

(65) Prior Publication Data

US 2018/0119899 A1 May 3, 2018

(30) Foreign Application Priority Data

Oct. 28, 2016 (FR) ..... 16 60529

(51) Int. Cl.

| | |
|---|---|
| ***F21K 9/69*** | (2016.01) |
| ***F21V 13/02*** | (2006.01) |
| ***F21V 13/04*** | (2006.01) |
| ***F21S 8/10*** | (2006.01) |
| ***F21S 41/30*** | (2018.01) |
| ***F21S 41/25*** | (2018.01) |
| ***F21S 41/143*** | (2018.01) |
| ***F21S 41/26*** | (2018.01) |

(52) U.S. Cl.

CPC ..... *F21K 9/69* (2016.08); *F21S 41/143* (2018.01); *F21S 41/25* (2018.01); *F21S 41/26* (2018.01); *F21S 41/30* (2018.01); *F21V 13/02* (2013.01); *F21V 13/04* (2013.01)

(58) Field of Classification Search

CPC .. F21K 9/69; F21V 13/02; F21V 13/04; F21S 48/13; F21S 48/125

See application file for complete search history.

(56) References Cited

U.S. PATENT DOCUMENTS

| | | | |
|---|---|---|---|
| 4,456,948 | A | 6/1984 | Brun |
| 5,068,768 | A | 11/1991 | Kobayashi |
| 2008/0151567 | A1 | 6/2008 | Albou |
| 2015/0241009 | A1 | 8/2015 | Brendle |

FOREIGN PATENT DOCUMENTS

| | | |
|---|---|---|
| EP | 1 936 260 A1 | 6/2008 |
| FR | 2 503 832 | 10/1982 |
| FR | 3 010 772 | 3/2015 |
| JP | 2-25101 U | 2/1990 |
| JP | 2003-31007 | 1/2003 |

OTHER PUBLICATIONS

French Preliminary Search Report dated Jul. 17, 2017 in French Application 16 60529 filed on Oct. 28, 2016 (with English Translation of Categories of Cited).

*Primary Examiner* — Joseph L Williams
(74) *Attorney, Agent, or Firm* — Oblon, McClelland, Maier & Neustadt, L.L.P.

(57) ABSTRACT

The invention relates to an optical module intended to project a final light beam having a profiled cutoff having at least one horizontal segment, including a controlled light source emitting an initial beam, and optical cutting-off means for converting the initial beam into an intermediate cutoff beam containing a cutoff, in which beam the light rays are distributed vertically below the profiled cutoff. The optical module includes horizontally focusing optical means for focusing the intermediate cutoff beam toward a substantially vertical line of focus, and an exit lens having a vertical focal line that is coincident with the line of focus in order to convert the intermediate cutoff beam into the final beam.

20 Claims, 5 Drawing Sheets

OPTICAL MODULE FOR PROJECTING A CUTOFF LIGHT BEAM INCLUDING HORIZONTALLY FOCUSING MEANS

TECHNICAL FIELD OF THE INVENTION

The invention relates to an optical module intended to project a final light beam having a profiled cutoff having at least one horizontal segment, and including:

a controlled light source emitting an initial beam; and optical cutting-off means for converting the initial beam into an intermediate cutoff beam, in which beam the light rays are distributed vertically below said profiled cutoff.

TECHNOLOGICAL BACKGROUND OF THE INVENTION

Certain regulatory motor-vehicle lights such as low-beam lights or fog lights must project a light beam that is bounded at the top by a profiled cutoff. This profiled cutoff is shaped so as to prevent the drivers of other vehicles from being dazzled.

The profiled cutoff extends horizontally on the whole, which allows the reach of the beam on the side of the road on which oncoming vehicles are likely to arrive, for example the left in France or the right in the United Kingdom, to be limited while illuminating over a larger distance that edge of the road which is located on the other side.

To this end, the profiled cutoff for example contains two staggered horizontal plateaus that are connected by an inclined intermediate segment. The inclination of the intermediate segment is for example 15° with respect to the horizontal.

Moreover, it is sought to produce lighting modules having a narrow exit face that is elongate vertically, i.e. orthogonally to the horizontal plateaus of the profiled cutoff. Such a lighting module thus allows a lighting or signaling light function that has a small transverse bulk to be produced.

Furthermore, such a narrow-exit-face lighting module allows designers to produce a vehicle having a visual signature that is recognizable from a distance.

BRIEF SUMMARY OF THE INVENTION

The invention provides a lighting module of the type described above, characterized in that the optical module includes:

horizontally focusing optical means for focusing the intermediate cutoff beam toward a substantially vertical line of focus; and an exit lens having a vertical focal line that is coincident with the line of focus in order to convert the intermediate cutoff beam into said final beam.

In one exemplary embodiment of the invention, the intermediate cutoff beam is emitted along a main axis coaxial with that of the final beam.

According to other features of the lighting module:

the light source is a semiconductor chip including a light-emitting surface including at least one rectilinear lower edge;

the optical module includes an entrance lens forming an optical cutting-off means and that is formed in order to convert at least one first portion of the initial beam into at least one first portion of the intermediate beam including at least one horizontal segment of the profiled cutoff;

the entrance lens is advantageously arranged to collimate the rays in a longitudinal vertical plane and to focus the rays in a horizontal plane toward the vertical focal line;

the entrance lens is focused on the lower rectilinear edge of the emitting surface, the clear image of this lower edge forming all or some of said horizontal segment of the profiled cutoff;

the entrance lens forms an optical focusing means focusing the light rays toward the vertical line of focus, the entrance lens for example has a focal line coincident with the vertical line of focus;

the light source is a semiconductor chip including a light-emitting surface including at least one horizontal upper edge;

the optical module includes a reflecting surface forming an optical cutting-off means and that receives at least one second portion of the rays of the initial beam in order to produce at least one second portion of the intermediate beam including at least one segment of the profiled cutoff;

according to one exemplary embodiment, the module includes a second entrance lens for receiving said second portion of the rays of the initial beam. For example, the first and second entrance lenses form a section via which the initial beam enters into the module, the first and second portions of the light rays forming the entirety of the initial beam received by this entrance section. The second entrance lens is for example a lens that is optically neutral, for example a lens that is spherical and centered on the middle of the chip.

the reflecting surface is divided into zones of distinct shapes each allowing one portion of the intermediate beam to be produced;

at least one first zone of the reflecting surface is focused on the upper edge of the emitting surface in order to form an oblique segment of the profiled cutoff, the clear image of this upper edge forming said oblique segment of the profiled cutoff;

at least one second zone of the reflecting surface is focused on the upper edge of the emitting surface in order to form a horizontal segment of the profiled cutoff, the clear image of this upper edge forming said horizontal segment of the profiled cutoff;

the reflecting surface forms an optical focusing means, the entirety of the reflecting surface focusing the light rays toward the vertical line of focus, each zone thus including a focal line coincident with the vertical line of focus;

the exit lens is designed to form the final beam by spreading the intermediate beam horizontally after it has been focused toward the line of focus while remaining neutral as regards the vertical distribution of the light rays;

the exit lens includes an exit face having a vertical height substantially larger than its transverse width;

the exit lens includes an exit face generated by a rectilinear vertical directrix that is moved over a curved horizontal generatrix;

the horizontal generatrix has a focal point arranged on the line of focus;

the optical module includes a solid block made of a single piece of transparent material including the optical cutting-off means, the optical focusing means, and the exit lens. For example, the optical means and the lenses are refractive surfaces formed by interior walls of this block, the material advantageously being chosen so that light rays penetrating into the block via an entrance section, in particular the entrance lens, propagate in the block via total internal reflection from these refractive surfaces to the exit lens;

the final beam is a regulatory low beam.

The invention also relates to a lighting device for a motor vehicle including a juxtaposition of a plurality of optical modules produced according to the teachings of the invention.

BRIEF DESCRIPTION OF THE FIGURES

Other features and advantages of the invention will become apparent on reading the following detailed description. For a better understanding of the description, the reader is referred to the appended drawings, in which.

DETAILED DESCRIPTION OF THE FIGURES

In the rest of the description, the following orientations will be adopted nonlimitingly:

longitudinal: directed from back to front in the exit direction of the final light beam;

vertical: directed from bottom to top; and transverse: directed orthogonally to the longitudinal and vertical directions.

A longitudinal transverse plane will be referred to as a "horizontal" plane.

The transverse orientation corresponds to the orientation of the horizontal plateau of the profiled cutoff of the final light beam. The vertical orientation is used as a geometric indicator without reference to the direction of gravity. The vertical orientation is defined as being orthogonal to the horizontal plateau of the profiled cutoff of the final light beam.

In the rest of the description, elements having a given structure or analogous functions will be referenced with the same references.

Figure 1:
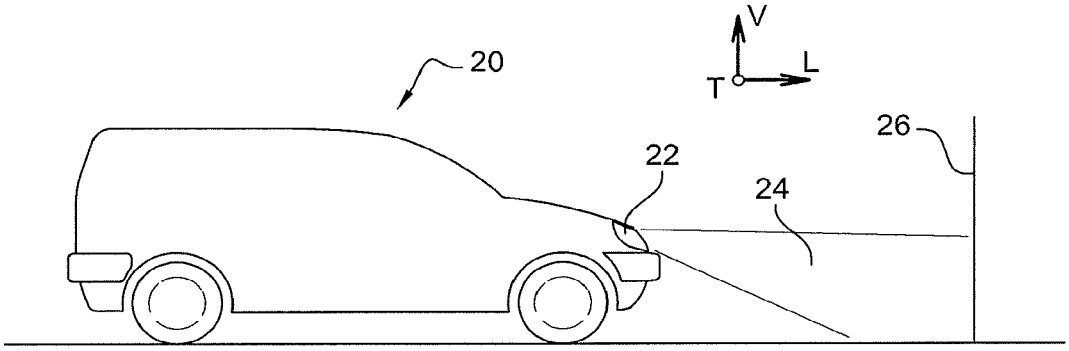
FIG. 1 is a side view which schematically shows a vehicle equipped with an optical module produced according to the teachings of the invention projecting a final light beam toward a screen located a distance away from the vehicle.

FIG. 1 shows a motor vehicle 20 equipped with an optical module 22 produced according to the teachings of the invention projecting a final light beam 24 forward longitudinally.

Figure 2:
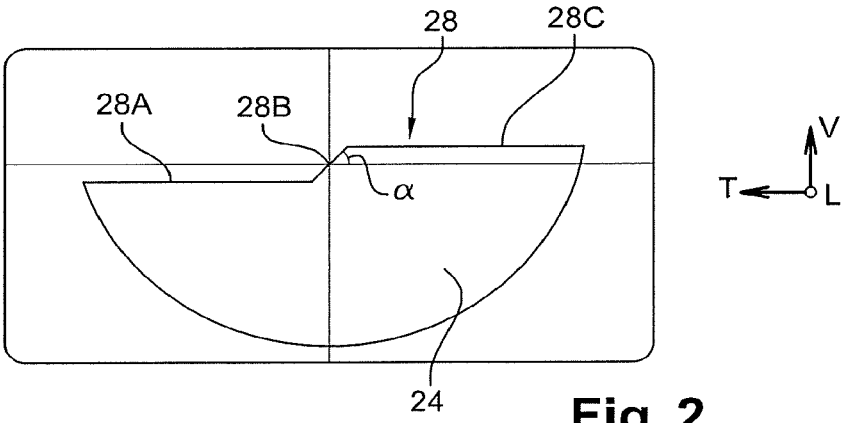
FIG. 2 is a front view that shows a face of the screen including a zone illuminated by the final light beam, said illuminated zone being bounded by a profiled cutoff.

It is a question of a final beam 24 having a profiled cutoff 28. FIG. 2 illustrates the zone illuminated by the final beam 24 on a transverse vertical screen 26 placed at 25 meters from the lighting device, perpendicularly to the optical axis, which intersects the screen 26 at the point where the x-axis and y-axis cross.

It may be seen that the zone illuminated by the final beam 24 is bounded at the top by a profiled cutoff 28. The profiled cutoff 28 contains at least one lower first horizontal plateau 28A and a second oblique segment 28B that is an extension of the first horizontal plateau 28A. This oblique segment 28B is inclined at a defined angle $\alpha$ to the horizontal plateau, for example an angle of 15°.

The final beam 24 is here a regulatory low beam.

The first horizontal plateau 28A makes it possible to prevent the drivers of oncoming vehicles from being dazzled. The profiled cutoff 28 is here suitable for a vehicle driven in a country requiring vehicles to be driven on the right-hand side of the road. The profiled cutoff 28 here includes an upper second horizontal plateau 28C that is an extension of the oblique segment 28B on the side opposite the lower first horizontal plateau 28A.

It will be understood that this profiled cutoff 28 is given by way of nonlimiting example.

Figure 3:
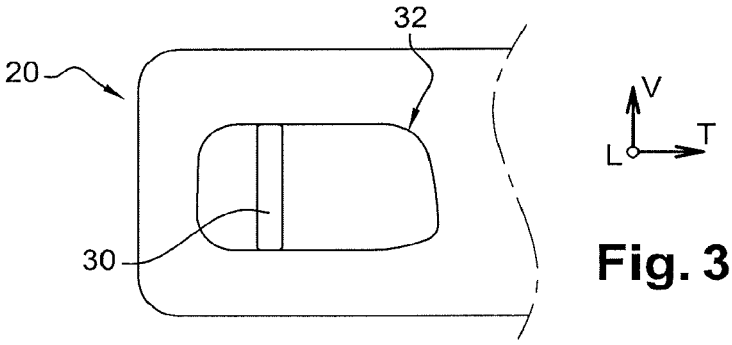
FIG. 3 is a front view that schematically shows a front lighting device of the motor vehicle including an optical module produced according to the teachings of the invention.

To obtain such a final cutoff beam 24, the invention provides an optical module 22 having a narrow exit face 30 having a transverse dimension that is very much smaller than its vertical dimension, as is illustrated in FIG. 3 showing a front lighting device 32 of the vehicle 20.

Such an optical module 22 includes a controlled light source 34 emitting an initial beam 46. It is for example a question of a semiconductor chip including a light-emitting surface. Such light-emitting chips are better known as light-emitting diodes or LEDs.

The optical module 22 also includes optical cutting-off means 36 for converting the initial beam 46 into an intermediate cutoff beam 48 in which the light rays are distributed vertically under said profiled cutoff, the intermediate cutoff beam being emitted along a longitudinal main axis that is coaxial with the axis of the final beam 24.

In order to allow a final cutoff beam 24 having a clear profiled cutoff 28 to be obtained, the optical module 22 also includes horizontally focusing optical means 38 for focusing the intermediate cutoff beam 48 toward a substantially vertical line of focus 54, and an exit lens 40 having a vertical focal line that is coincident with the line of focus in order to convert the intermediate cutoff beam into said final beam.

The expression "horizontally focusing" is understood to mean that the direction of propagation of the light rays in projection on a longitudinal vertical plane is substantially not deviated by said optical means 38 whereas the direction of propagation of the light rays in projection on a horizontal plane is deviated toward the line of focus 54.

This arrangement allows a final beam 24 to be obtained in which the profiled cutoff 28 is an image, inverted about a vertical line of symmetry, of the profiled cutoff of the intermediate beam 48, given that the intermediate beam 48 is focused toward a single vertical line of focus 54.

Furthermore, the fact that the intermediate beam 48 is focused toward the vertical line of focus 54 makes it possible to precisely and controllably distribute the light rays in the final beam 24. This in particular allows the distribution of the light intensity in the final beam 24 to be controlled.

Figure 4:
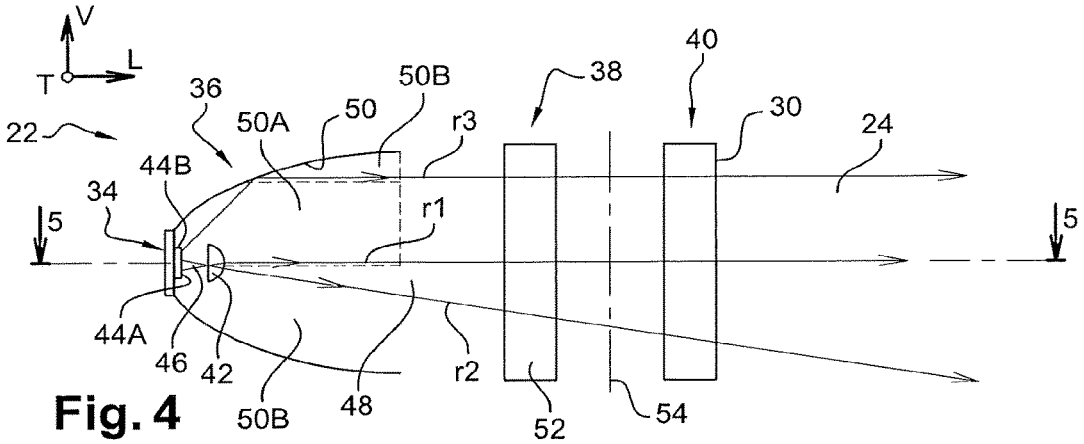
FIG. 4 is a vertical longitudinal cross-sectional view showing the sectional plane 4-4 of FIG. 5 passing through an optical axis of the optical module, which is the optical module produced according to a first embodiment of the invention.
Figure 5:
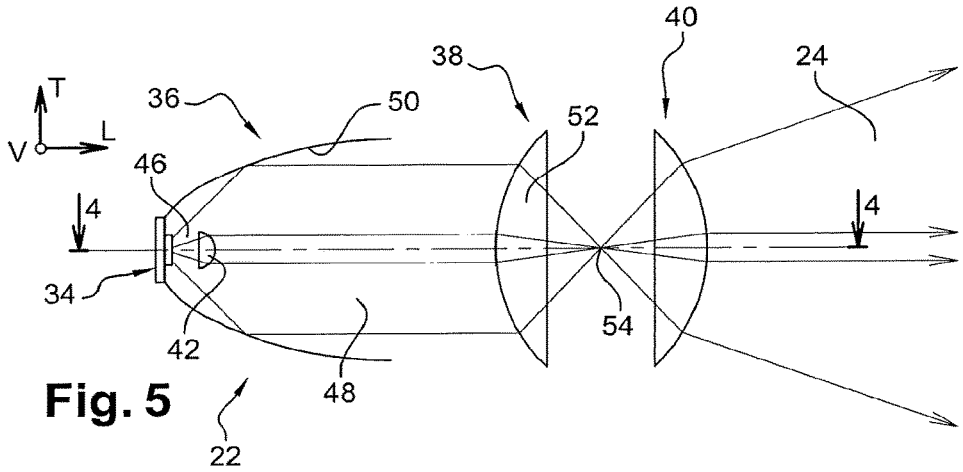
FIG. 5 is a horizontal cross-sectional view showing the sectional plane 5-5 of FIG. 4 passing through an optical axis of the optical module, which is the optical module produced according to the first embodiment of the invention.

In a first embodiment of the invention shown in FIGS. 4 and 5, the cutting-off means 36 and the focusing means 38 are formed by distinct elements.

Figure 6:
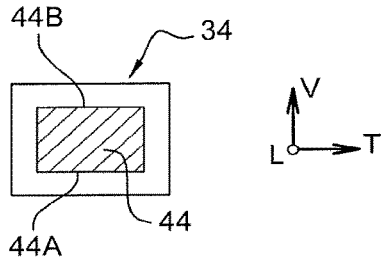
FIG. 6 is a front view at larger scale that schematically shows the light source of the optical module.

The light source 34 is a chip that has a light-emitting surface 44 A of rectangular shape as is illustrated in FIG. 6. The light-emitting surface 44 is thus bounded vertically by a lower transverse edge 44A and by a upper transverse edge 44B.

The light source 34 is arranged so as to emit an initial light beam 46 in a longitudinal direction oriented forward. To this end, the light-emitting surface 44 is thus arranged vertically transversely and turned forward. The initial light beam 46 more particularly has a main emission axis that is substantially coaxial with a main emission axis of the final beam 24.

The cutting-off means 36 are arranged directly in front of the light source 34 so as to form all the light rays of the initial beam 46 into an intermediate cutoff beam 48 having a profiled cutoff that is symmetric with the profiled cutoff of the final beam 24 with respect to a central vertical axis.

The cutting-off means 36 include an entrance lens 42 that is formed in order to convert at least one first portion of the initial beam 46 into at least one first portion of the intermediate beam including at least one horizontal segment of the profiled cutoff.

To this end, an object focal point of the lens 42 is arranged substantially on the lower edge 44A of the light-emitting surface 44. Thus, the entrance lens 42 is focused on the lower rectilinear edge 44A of the emitting surface 44.

The light rays emitted by the lower edge 44A form substantially longitudinal collimated light rays in the intermediate beam 48. This is illustrated by the ray r1 illustrated in FIG. 4. The light rays r2 issued from the rest of the emitting surface 44 are distributed in the intermediate beam 48 below the rays r1 issued from the lower edge.

A clear image of the lower edge 44A of the light-emitting surface 44 is thus formed in the intermediate beam 48 in order to form said horizontal segment of the profiled cutoff 28.

Some light rays of the initial beam 46 are not collected by the entrance lens 42. These light rays pass around the lens 42 without being deviated.

The cutting-off means 36 have a reflecting surface 50 that receives these non-collected rays of the initial beam in order to produce at least one second portion of the intermediate beam including at least one second segment of the profiled cutoff 28.

The reflecting surface 50 is a complex surface divided into zones of distinct shapes each allowing one portion of the intermediate beam to be produced.

A first zone 50A of the reflecting surface is focused on the upper edge 44B of the light-emitting surface 44.

The light rays emitted by the upper edge 44B form substantially longitudinal collimated light rays in the intermediate beam 48. This is illustrated by the ray r3 illustrated in FIG. 4. The light rays issued from the rest of the emitting surface 44 are distributed by the zone 50A below the rays r3 issued from the upper edge 44B in the intermediate beam 48. Furthermore, the image of the upper edge 44B is turned by 15° about the longitudinal axis in order to form the oblique segment 28B of the profiled cutoff 28.

At least one second zone 50B of the reflecting surface is focused on the upper edge 44B of the light-emitting surface 44 in order to form a horizontal segment of the profiled cutoff 28. In the example shown in FIG. 4, the reflecting surface 50 includes two zones 50B that are vertically arranged on either side of the first reflecting zone 50A.

The light rays emitted by the upper edge 44B form substantially longitudinal collimated light rays in the intermediate beam 48. The light rays issued from the rest of the emitting surface 44 are distributed by the zone 50B below the rays issued from the upper edge 44B in the intermediate beam 48. The clear image of this upper edge 44B thus forms a horizontal segment of the profiled cutoff 28.

As is illustrated in FIG. 5, the entrance lens 42 and the reflecting surface 50 are formed so as to collimate light rays of the intermediate beam 48 in a horizontal plane.

The focusing means 38 are here formed by a cylindrical convergent lens 52 that is placed on the path of the intermediate beam 48. This lens 52 is designed to leave unchanged the distribution of the light rays in a longitudinal vertical plane, as is indicated in FIG. 4, and to focus the light rays of the intermediate beam 48 toward a vertical line of focus 54 as is indicated in FIG. 5.

To this end, the convergent lens 52 has a cylindrical shape of vertical rectilinear directrix.

The exit lens 40 is placed in the intermediate beam 48, longitudinally in front of the vertical line of focus 54. The exit lens 40 is designed to form the final beam 24 by spreading the intermediate beam 48 horizontally after it has been focused on the line of focus 54, as illustrated in FIG. 5, while remaining neutral as regards the vertical distribution of the light rays, as illustrated in FIG. 4.

To this end, the exit lens 40 includes an exit face 30 generated by a rectilinear vertical directrix that is moved over a curved horizontal generatrix. The horizontal generatrix has a focal point arranged on the line of focus 54. The exit face 30 has, in horizontal cross section, a form suitable for spreading the light rays on either side of the main emission axis. The exit face 30 for example has an ellipsoidal form.

This arrangement advantageously allows an exit lens 40 to be obtained having an exit face 30 the vertical height of which is substantially larger than its transverse width, as illustrated in FIG. 3.

Furthermore, this arrangement allows a clear profiled cutoff 38 to be obtained that allows the regulations in force to be complied with as well as can be.

As a variant of this first embodiment, the optical cutting-off means are produced via other known arrangements, for example by means of a reflector and a shield a free edge of which allows the profiled cutoff to be formed.

Figure 7:
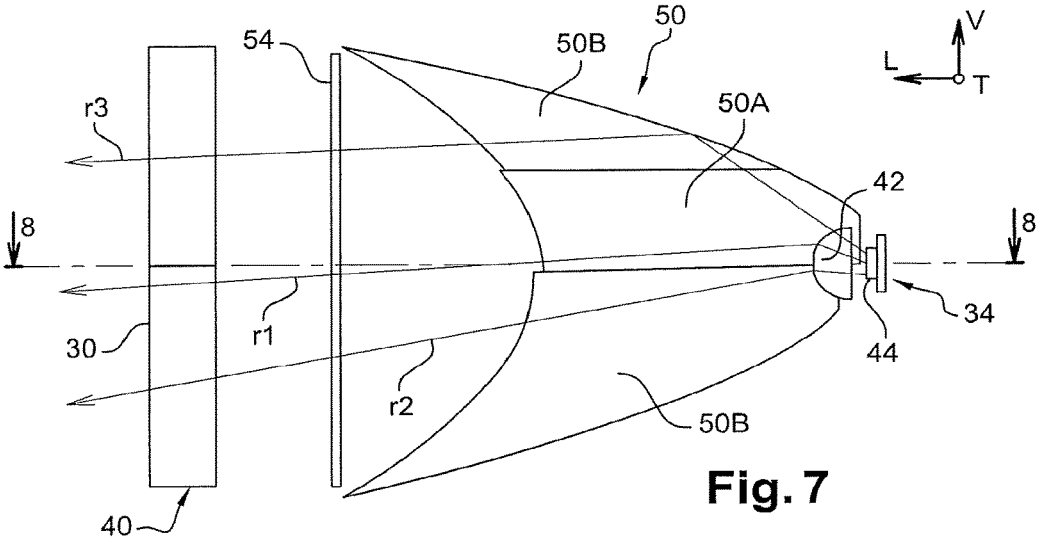
FIG. 7 is a similar view to that of FIG. 4, which shows a second embodiment of the optical module.
Figure 8:
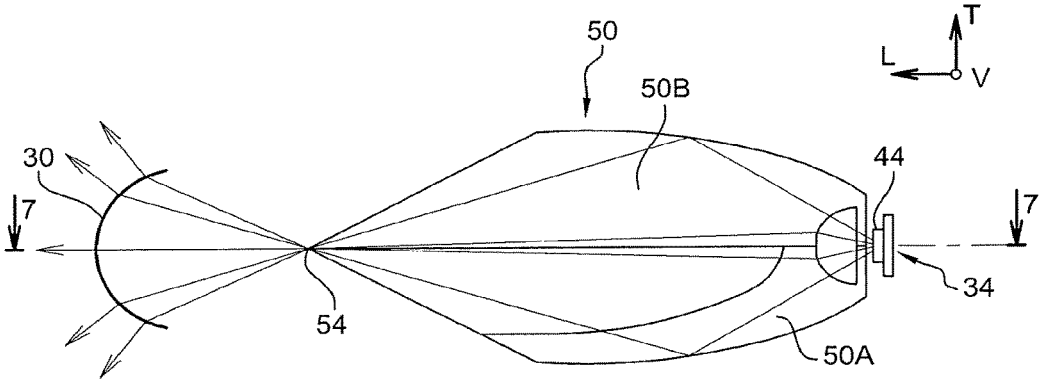
FIG. 8 is a similar view to that of FIG. 5, which shows a second embodiment of the optical module.

According to a second embodiment of the invention, which is shown in FIGS. 7 and 8, the optical cutting-off means and the focusing means are formed by the same elements. This advantageously allows an optical module 22 that is less bulky longitudinally to be obtained.

In this embodiment, the optical module 22 includes a light source 34 that is identical to that described in the first embodiment.

The optical module 22 also includes an entrance lens 42 and a complex reflecting surface 50 that allow an intermediate cutoff beam 48 to be obtained the light rays of which are distributed in a vertical plane in an identical way to that described with respect to the first embodiment. This has been illustrated in FIG. 7.

In contrast, unlike the first embodiment, the entrance lens 42 simultaneously forms an optical cutting-off means and an optical focusing means. It is thus formed to focus the light rays of the intermediate beam 48 directly toward the vertical line of focus 54 as is illustrated in FIG. 8. The entrance lens 42 for example has a focal line coincident with the line of focus 54.

Likewise, the reflecting surface 50 simultaneously forms an optical cutting-off means and an optical focusing means. Thus, the entirety of the reflecting surface 50 focuses the light rays of the intermediate beam 48 directly toward the vertical line of focus 54, as is illustrated in FIG. 8. Thus, each zone 50A, 50B of the reflecting surface 50 has a focal line coincident with the vertical line of focus 54.

The exit lens 40 is identical to that described in the first embodiment.

This second embodiment allows the convergent lens 52 of the first embodiment to be removed. The optical module 22 thus has a small longitudinal bulk.

Furthermore, performing the cutting-off and focusing functions simultaneously with the same elements allows the various elements of the optical module 22 to be produced in a single block 58 of transparent material, with the exception of the light source 34.

The optical module 22 thus obtained is particularly compact. In addition, the block 58 is inexpensive to manufacture. Furthermore, installation of the optical module 22 into a lighting device 32 of a vehicle 20 is particularly easy and rapid because the optical module 22 includes only two parts, namely the block 58 and the light source 34.

Figure 9:
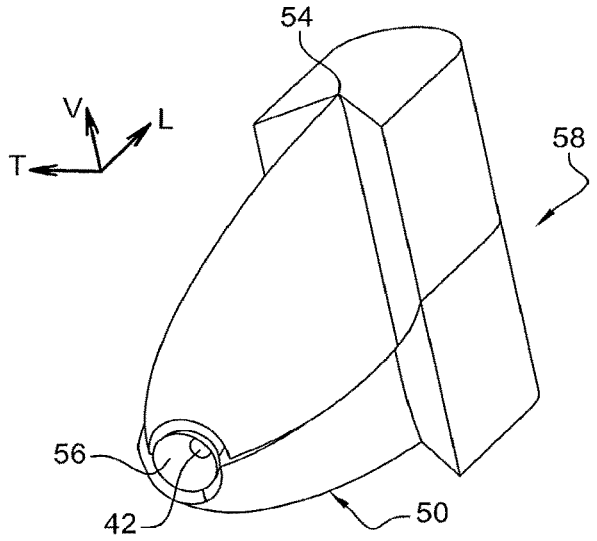
FIGS. 9 and 10 are perspective views from different points of view that show the optical module according to the second embodiment including a block uniting in a single part the cutting-off means, the focusing means and the exit lens.
Figure 10:
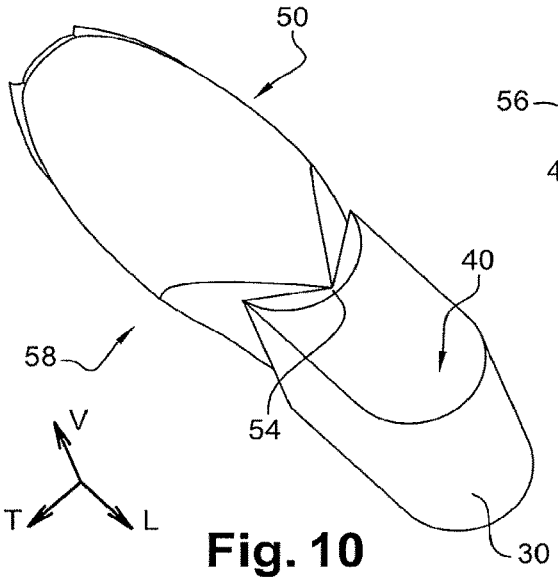

As is illustrated in FIGS. 9 and 10, in such an optical module 22, the entrance lens 42 is formed by a back entrance face of the block 58, which face is arranged directly opposite the light source 34

The reflecting surface 50 is formed by a face bounding the block 58 of the optical module 22 radially and forming a refractive surface. This reflecting surface 50 allows the light rays issued from the light source 34 to be totally reflected.

If needs be, the reflecting surface 50 can be at least partially coated with aluminum in order to allow all of the light rays issued from the light source 34 to be reflected.

Figure 11:
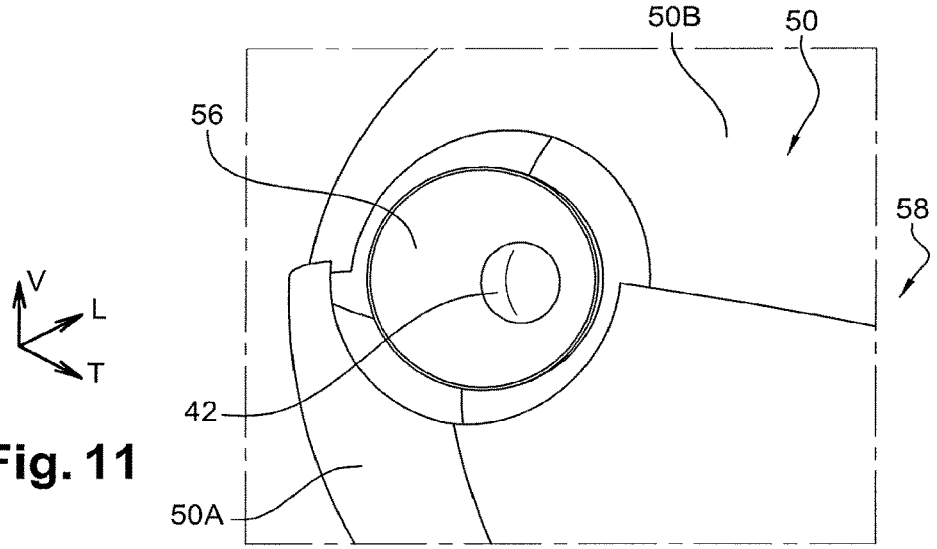
FIG. 11 is a detailed view at larger scale of the block of FIG. 9, which shows the entrance lens circumscribed by a neutral entrance lens.

As is shown in FIG. 11, the entrance lens 42 forms a first entrance lens 42 that is circumscribed by an annular second entrance lens 56 of the block 58. The second entrance lens 56 is optically neutral, i.e. it is formed in order to allow those light rays issued from the light source 34 which are not collected by the entrance lens 42 to penetrate into the block 58 of the optical module 22 without being substantially deviated. The neutral second entrance lens 56 is thus inserted radially between the first lens 42 and a back end of the reflecting surface 50.

The neutral second entrance lens 56 for example has a hemispherical form that is centered on the light-emitting surface 44. The neutral second lens 56 is thus formed in a concave manner in a back face of the block 58 and it includes in its center the first entrance lens 42.

The exit lens 40 is formed in one piece with the block 58 in front of the reflecting surface 50. The exit face 30 of the exit lens 40 forms a front end face of the block 58.

The block 58 is for example produced by extrusion, along a vertical axis, of a transparent plastic material. The material is advantageously chosen so that light rays penetrating into the block via the entrance lens 42 and the neutral surface 56 propagate in the block 58 by total internal reflection from the reflecting surface 50 to the exit lens 40.

According to one variant (not shown) of this second embodiment, the reflecting surface is formed by the internal face of a reflector that is distinct from the entrance lens and the exit lens is formed by an independent third element.

Figure 12:
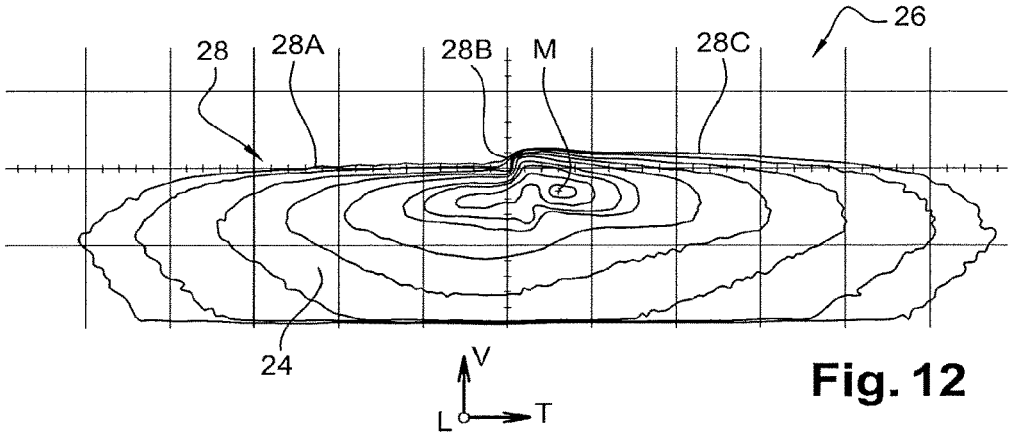
FIG. 12 is a similar view to that of FIG. 2, which shows the isolux curves of the zone illuminated by the final beam projected by the optical module produced according to the second embodiment.

A zone illuminated on the screen 26 of FIG. 1 has been illustrated in FIG. 12, which shows isolux curves.

The point M is located in the vicinity of the point where the horizontal and vertical axes cross, and corresponds to the point of the beam where the illumination is highest. This point M is surrounded by closed curves of increasing size corresponding to illumination of lower and lower intensity. Each curve corresponds to a constant value in lux that decreases from the point M to the exterior. In the case of FIG. 12, the point M corresponds to 35.7 lux, the first closed curve surrounding M corresponds to 32 lux, then each following curve corresponds to a decrease of 8 lux.

Thus, a single optical module 22 thus allows a regulatory low beam to be produced.

Figure 13:
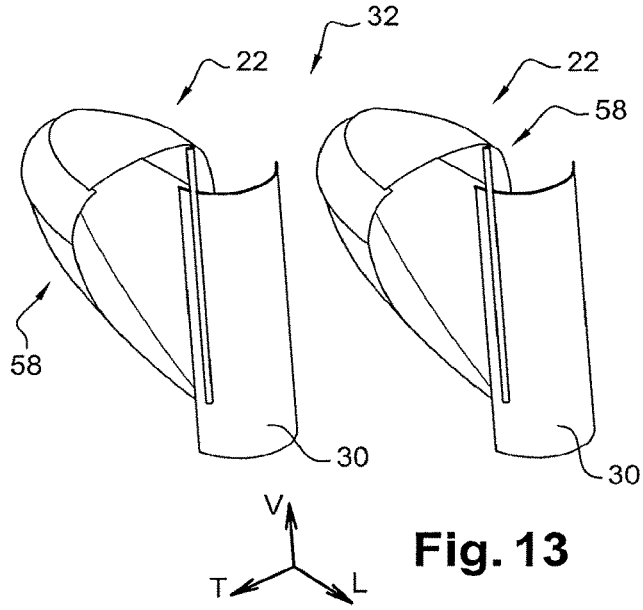
FIG. 13 is a perspective view that shows a lighting device including a juxtaposition of two optical modules arranged parallelly.
Figure 14:
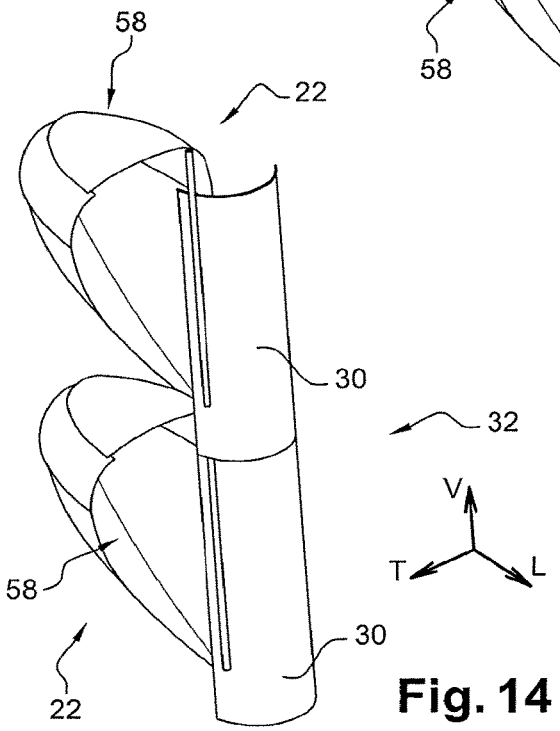
FIG. 14 is a perspective view that shows a lighting device including a juxtaposition of two optical modules aligned vertically.

As is illustrated in FIGS. 13 and 14, the vehicle may be equipped with a lighting device including a juxtaposition of a plurality of lighting modules 22 produced according to the teachings of the invention.

Such a juxtaposition may be performed for aesthetic reasons and/or in order to make it possible to obtain light beams having characteristics suitable for a particular signaling or lighting function.

Thus, as shown in FIG. 13, the lighting device 32 includes two identical optical modules 22. Each optical module 22 includes a block 58 produced according to the second embodiment of the invention. The two optical modules 22 are arranged parallelly one beside the other transversely so that their exit faces 30 are substantially in the same transverse vertical plane. These two optical modules 22 are controlled simultaneously in order to perform the same lighting or signaling function via superposition of their final beams 24.

In the example shown in FIG. 14, the lighting device 32 includes two optical modules 22 that are arranged vertically one above the other. The exit face 30 of the lower optical module 22 is thus arranged vertically in the extension of the optical face 30 of the upper optical module 22.

The optical module 22 produced according to any one of the embodiments of the invention thus allows a beam containing a clear cutoff to be projected through an exit face that is transversely narrow and vertically elongate. Such an optical module has a small transverse bulk.

Furthermore, the second embodiment of the invention allows an optical module of small longitudinal bulk to be obtained.

In addition, the optical module produced in a block according to the second embodiment of the invention is particularly simple to manufacture and inexpensive.

The invention claimed is:

1. Optical module intended to project a final light beam having a profiled cutoff having at least one horizontal segment, and including:

a controlled light source emitting an initial beam; and optical cutting-off means for converting the initial beam into an intermediate cutoff beam containing a cutoff, in which beam the light rays are distributed vertically below said profiled cutoff;

wherein the optical module includes:

horizontally focusing optical means for focusing the intermediate cutoff beam toward a substantially vertical line of focus; and an exit lens having a vertical focal line that is coincident with the line of focus in order to convert the intermediate cutoff beam into said final beam.

2. Optical module according to claim 1, wherein the light source is a semiconductor chip including a light-emitting surface including at least one rectilinear lower edge.

3. Optical module according to claim 2, wherein the module includes an entrance lens forming an optical cutting-off means and that is formed in order to convert at least one first portion of the initial beam into at least one first portion of the intermediate beam including at least one horizontal segment of the profiled cutoff.

4. Optical module according to claim 3, wherein the entrance lens is focused on the lower rectilinear edge of the emitting surface, the clear image of this lower edge forming all or some of said horizontal segment of the profiled cutoff.

5. Optical module according to claim 3, wherein the entrance lens forms an optical focusing means focusing the light rays toward the vertical line of focus.

6. Module according to claim 1, wherein the light source is a semiconductor chip including a light-emitting surface including at least one horizontal upper edge.

7. Optical module according to claim 6, the module includes a reflecting surface forming an optical cutting-off means and that receives at least one second portion of the rays of the initial beam in order to produce at least one second portion of the intermediate beam including at least one segment of the profiled cutoff.

8. Optical module according to claim 7, wherein the reflecting surface is divided into zones of distinct shapes each allowing one portion of the intermediate beam to be produced.

9. Optical module according to claim 8, wherein at least one first zone of the reflecting surface is focused on the upper edge of the emitting surface in order to form an oblique segment of the profiled cutoff, the clear image of this upper edge forming said oblique segment of the profiled cutoff.

10. Module according to claim 8, wherein at least one second zone of the reflecting surface is focused on the upper edge of the emitting surface in order to form a horizontal segment of the profiled cutoff, the clear image of this upper edge forming said horizontal segment of the profiled cutoff.

11. Optical module according to claim 7, wherein that the reflecting surface ROOM forms an optical focusing means, the entirety of the reflecting surface focusing the light rays toward the vertical line of focus.

12. Optical module according to claim 1, wherein the exit lens is designed to form the final beam by spreading the intermediate beam horizontally after it has been focused toward the line of focus while remaining neutral as regards the vertical distribution of the light rays.

13. Optical module according to claim 12, wherein the exit lens includes an exit face having a vertical height substantially larger than its transverse width.

14. Module according to claim 12, wherein the exit lens includes an exit face generated by a rectilinear vertical directrix that is moved over a curved horizontal generatrix.

15. Optical module according to claim 14, wherein the horizontal generatrix has a focal point arranged on the line of focus.

16. Optical module according to claim 1, wherein the module includes a solid block made of a single piece of transparent material including:

the optical cutting-off means;

the optical focusing means; and the exit lens.

17. Optical module according to claim 1, wherein the final beam is a regulatory low beam.

18. Lighting device for a motor vehicle including a juxtaposition of a plurality of optical modules produced according to claim 1.

19. Optical module according to claim 4, wherein the entrance lens forms an optical focusing means focusing the light rays toward the vertical line of focus.

20. Module according to claim 2, wherein the light source is a semiconductor chip including a light-emitting surface.

* * * * *